United States Patent [19]

de Jong et al.

[11] Patent Number: 4,805,371

[45] Date of Patent: Feb. 21, 1989

[54] BUILDING STRUCTURES

[75] Inventors: Jan de Jong, Florauna; Johan van Wyk, Pretoria, both of South Africa

[73] Assignee: Level Construction Company (Proprietary) Limited, Pretoria, South Africa

[21] Appl. No.: 858,765

[22] Filed: May 2, 1986

[30] Foreign Application Priority Data

May 3, 1985 [ZA] South Africa ..... 85/3343

[51] Int. Cl.[4] ..... E04B 7/00

[52] U.S. Cl. ..... 52/745; 52/80; 52/89; 52/259; 52/609

[58] Field of Search ..... 52/80, 245, 264, 259, 52/743, 608, 609, 89, 745, 741

[56] References Cited

U.S. PATENT DOCUMENTS

| | | | |
|---|---|---|---|
| 318,324 | 5/1885 | Terrell et al. | 52/80 |
| 495,411 | 4/1893 | Heatley | 52/609 |
| 954,410 | 5/1910 | Gossett | 52/89 |
| 1,281,976 | 10/1918 | Keim | 52/609 |
| 1,374,490 | 4/1921 | Chrisman | 52/609 |
| 1,403,177 | 1/1922 | Mack | 52/608 |
| 2,095,937 | 10/1937 | Kernan | 52/609 |
| 2,711,003 | 6/1955 | Child, Jr. | 52/80 |
| 3,171,370 | 3/1965 | Fay | 52/80 |
| 3,180,057 | 4/1965 | Pritzker | 52/246 |
| 3,619,432 | 11/1971 | Harrington | 52/80 |
| 3,824,751 | 7/1974 | Shelander | 52/245 |
| 3,841,038 | 10/1974 | Geiger | 52/80 |
| 4,315,385 | 2/1982 | Moreau et al. | 52/80 |

OTHER PUBLICATIONS

Bulletin of the IASS No. 10, 1960, 6 pages.

*Primary Examiner*—David A. Scherbel
*Assistant Examiner*—Caroline D. Dennison
*Attorney, Agent, or Firm*—Pollock, Vande Sande & Priddy

[57] ABSTRACT

A method of making a domed building structure includes locating a ring beam having a radially inwardly extending circumferential locating formation on top of an upwardly extending building structure. The method also includes locating a plurality of prefabricated dome units adjacent one another on the locating formation of the ring beam, in a first annular course. Further annular courses are then located in position, thereby to form a domed top.

3 Claims, 6 Drawing Sheets

BUILDING STRUCTURES

This invention relates to building structures. It relates in particular to domed building structures.

According to a first aspect of the invention, there is provided a method of making a domed building structure, which includes locating a ring beam having a radially inwardly extending circumferential locating formation, on top of an upwardly extending building structure;

locating a plurality of prefabricated dome units adjacent one another on the locating formation of the ring beam, thereby to form at least a portion of a self-supporting domed top on the building structure.

The building structure may be circular in plan view, and the locating formation may comprise a peripheral lip protruding beyond a circumferentially extending shoulder on the ring beam, the location of the units on the ring beam lip being effected by mating edges of the units with the lip of the ring beam.

The building structure may comprise a circular wall of cementitious material. The method may include erecting the wall prior to locating the ring beam on it.

Said edges of the units may be spaced with clearance from the shoulder of the ring beam so that there is a gap between them. The method may include introducing a settable material into this gap.

The units may be arranged in successive annular courses extending progressively radially inwardly from the ring beam to the centre of the dome top. The units of at least one of the courses may be staggered with respect to these of an adjacent course.

The components of the domed building structure, such as the building structure, the ring beam, and the units, may be reinforced or may be pre-stressed.

The method may include providing a central dome section within the innermost annular course of units at the centre of the domed top or roof.

The building structure may be a reservoir body, so that the domed building structure is a domed reservoir.

According to a second aspect of the invention there is provided a prefabricated dome unit for use in forming a dome top or roof on a building structure, the unit including a body having a first edge; a second edge opposite the first edge and comprising a shoulder and a protruding lip defining between them a recess for receiving the first edge of an adjacent unit; a third edge extending transversely to the first and second edges; a fourth edge also extending transversely to the first and second edges and being opposite the third edge.

The third and fourth edges may taper inwardly towards each other, from the first edge towards the second edge. In one embodiment, the unit may be in the form of a substantially planar panel. In another embodiment, the unit may be in the form of a panel which is arcuate-shaped when sectioned through at least one pair of opposed edges. It may be arcuate shaped when sectioned through both pairs of opposed edges.

The third and/or forth edges may have elongate recessed portions so that when the third edge of one unit is located alongside the fourth edge of an adjacent unit an upwardly open groove is defined along the joint between the two units.

The units may be pre-cast units. In one embodiment, the units may be precast from cementitious material, optionally reinforced with reinforcing. In another embodiment, they may be precast from plastics material, optionally reinforced with reinforcing. For example, they may then be of glassfibre-reinforced settable plastics material or resin.

According to a third aspect of the invention, there is provided a domed building structure which includes an upwardly extending circular building structure;

a ring beam extending around the top of the building structure, the ring beam having a radially inwardly extending circumferential locating formation;

a self-supporting domed top spanning the space within the ring beam, the domed top comprising a first annular course of dome units located on the locating formations of the ring beam, at least one units located radially inwardly of the first course, and a central dome section at the centre of the innermost annular course of units.

According to a fourth aspect of the invention there is provided a method of making a domed building structure, which includes movably locating, in a first position within an upwardly extending cylindrical building structure, a framework supporting a mould for forming a segment or section of a dome top on top of the structure;

casting a first dome section in the mould by introducing settable material into the mould;

allowing the material to set at least partially;

moving the framework so that the mould is located in a second position spaced from the first position; and casting a second dome section in the mould.

The framework may include an arcuate-shaped framework member when seen from the side, with the mould also being arcuate-shaped when seen from the side. The length of the framework member and mould may be such that they span the diameter of the building structure. The width of the mould at its opposed ends may be less than 25% of the circumference of the building structure. The mould width may be less than 10% of the circumference of the building structure. For example, it may be about 5% of the building structure circumference. The movement of the framework may be effected by rotating it about a rotational axis which is coincident with the axis of the building structure.

The framework may include a pair of diametrically opposed wheels, one wheel being located at or near each of the respective diametrically opposed ends of the framework member. The framework may include two pairs of diametrically opposed wheels, the wheels at each end of the framework member being located in tandem. The wheels may be attached to the framework by means of extensible members so that the distance between the wheels and the framework can be varied.

The framework may include a further similar framework member, mould and wheels, extending orthogonally to the first framework member and attached thereto.

The method may then include locating the wheels of the structure on an annular guide surface adjacent the inner periphery of the building structure. The guide surface may be mounted on a framework or support located inside the wall, so that the guide surface is located above ground level.

The method may also include, prior to casting the first dome section, providing a radially inwardly extending circumferential ring beam along the upper periphery of the building structure, the first dome section then being located diametrically between opposing sections of the ring beam.

The method may further include spanning the diametric distance between opposing sections of the ring beam and/or the building structure with an elongate tie member prior to casting the section in the mould, the tie member being located below the mould. The tie member may be tensioned. The tie member may be located between the two wheels at each end of the framework member. Hence, the tie member will be straddled by a leading wheel and a trailing wheel at each end of the framework member.

The method may then include, to permit the framework to be moved from its first to its second position, lifting the trailing wheel at each end of the framework member so that it is clear of the guide surface;

moving or rotating the framework so that the trailing wheel passes over the tie member;

lowering the trailing wheel until it again engages the guide surface; and rotating the framework until it is in the second position.

According to a fifth aspect of the invention, there is provided apparatus for making a domed roof for a building structure, which includes a framework adapted to span diametrically the inside of an upwardly extending round cylindrical reservoir body;

a mould, attached to the framework, for moulding a dome roof section in;

means, associated with the framework, for permitting the framework to be moved or rotated within the reservoir body from a first position to a second position.

The means may comprise at least one pair of diametrically opposed wheels attached to the framework as hereinbefore described, and an annular support surface for the wheels, locatable adjacent the inner periphery of the reservoir body, at a level above ground level.

The framework may comprise framework sections, releasably attached together. At least some of the framework sections may be similar so that the number of sections in the framework can be varied, thereby to adjust the length of the framework.

According to a sixth aspect of the invention, there is provided a method of making a domed building structure, which includes erecting an upwardly extending elongate support member inside an upwardly extending cylindrical building structure;

spanning elongate members between the support member and the building structure; and locating a cover member over the elongate members and the support member, thereby to form a domed top on top of the building structure.

The support member may be a centrally located mast, and may be provided with a cap at its upper end.

The elongate members may be flexible, and may comprise cables. The cables may extend radially outwardly from the cap to the wall at a high level. Cables extending concentrically around the cap and attached to the other cables, may also be provided.

The invention extends also to a domed building structure when made according to any one of the methods as hereinbefore described.

The invention will now be described by way of example with reference to the accompanying diagrammatic drawings.

Figure 1:
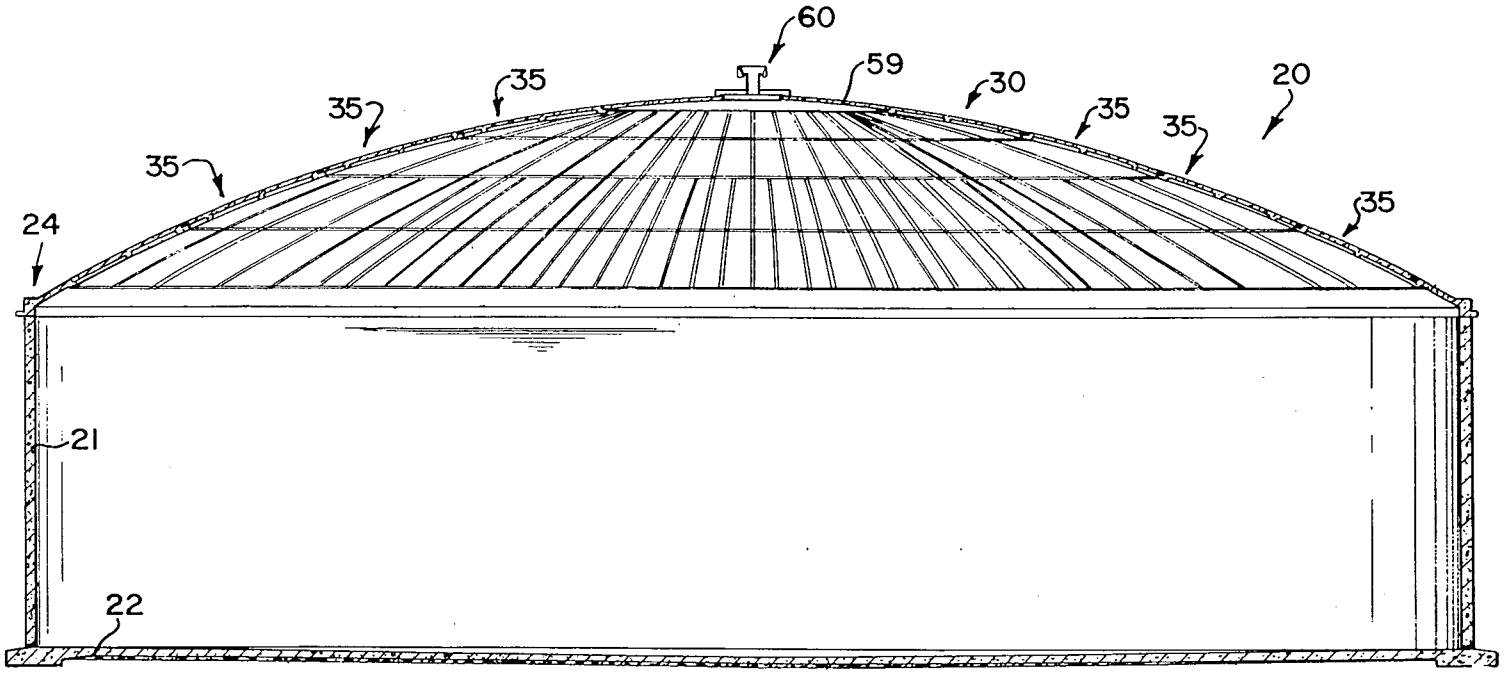
FIG. 1 shows a diametric sectional view of a domed reservoir made in accordance with the method of the first aspect of the invention.
Figure 2:
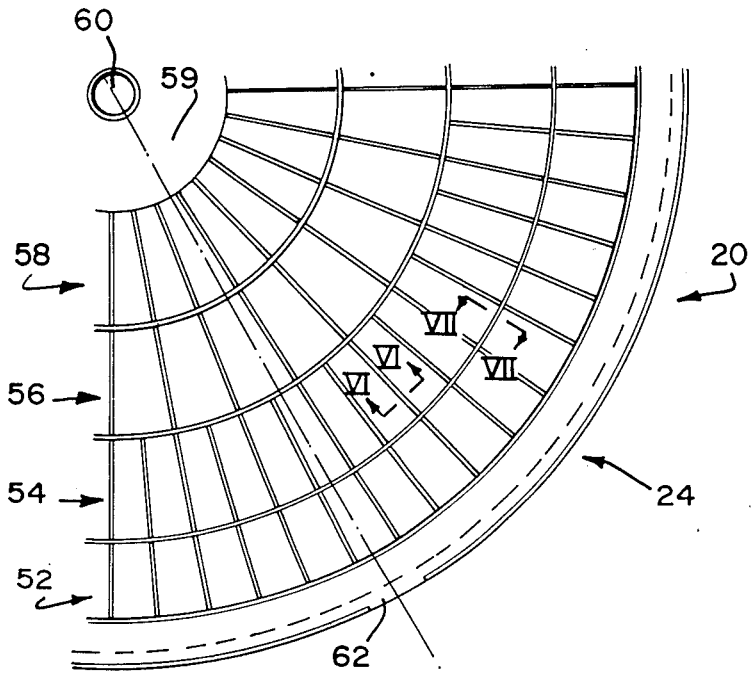
FIG. 2 shows, in part, a plan view of the reservoir of FIG. 1.
Figure 3:
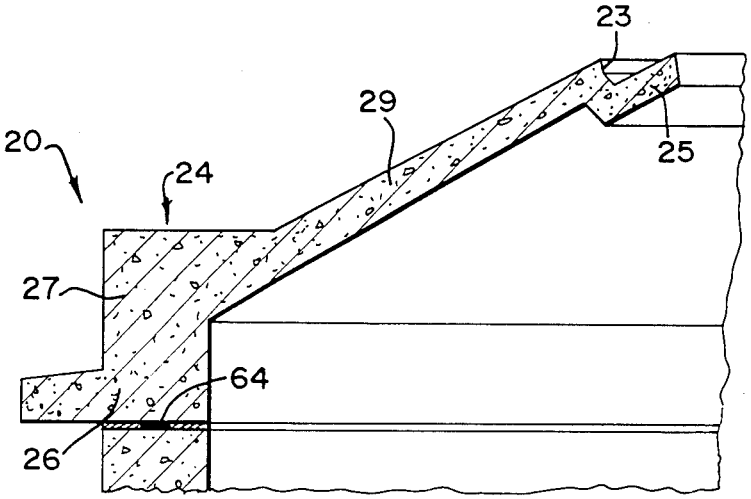
FIG. 3 shows an enlarged sectional view of part of the reservoir of FIG. 1.
Figure 4:
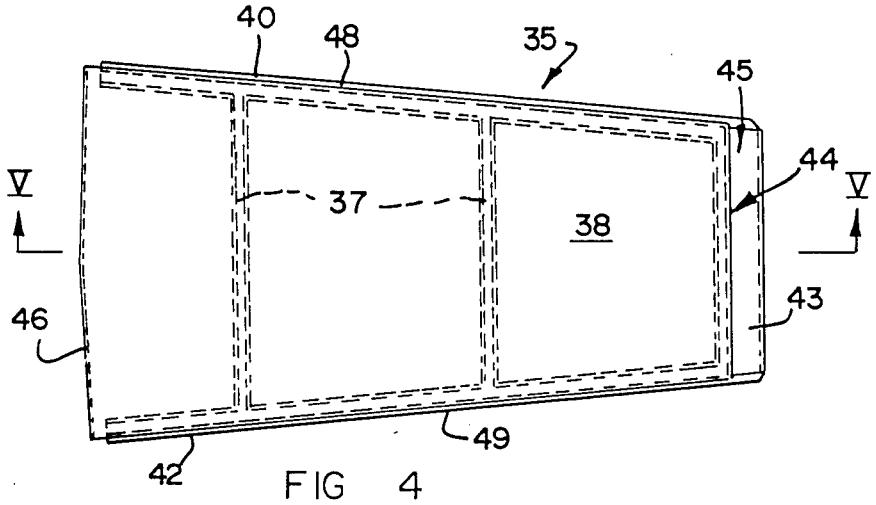
FIG. 4 shows a plan view of one of the panels of FIG. 1.
Figure 5:
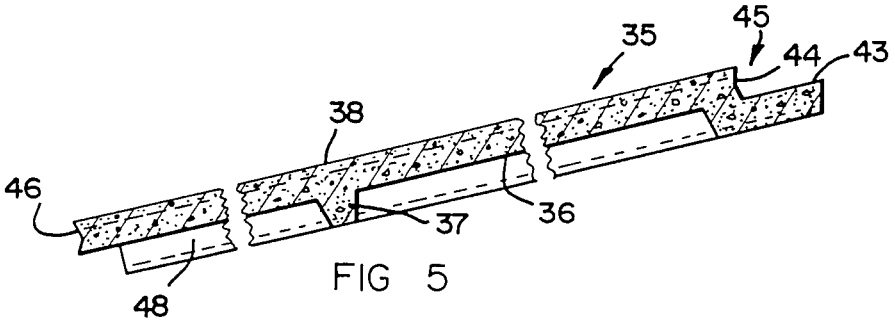
FIG. 5 shows a sectional view through V—V in FIG. 4.
Figure 6:
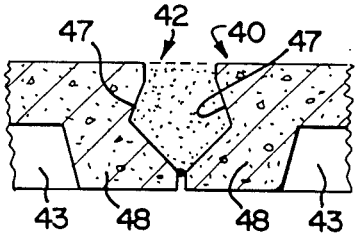
FIG. 6 shows a sectional view through VI—VI in FIG. 2.
Figure 7:
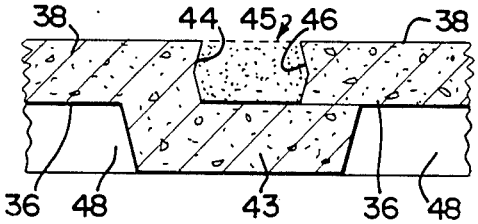
FIG. 7 shows a sectional view through VII—VII in FIG. 2.
Figure 8:
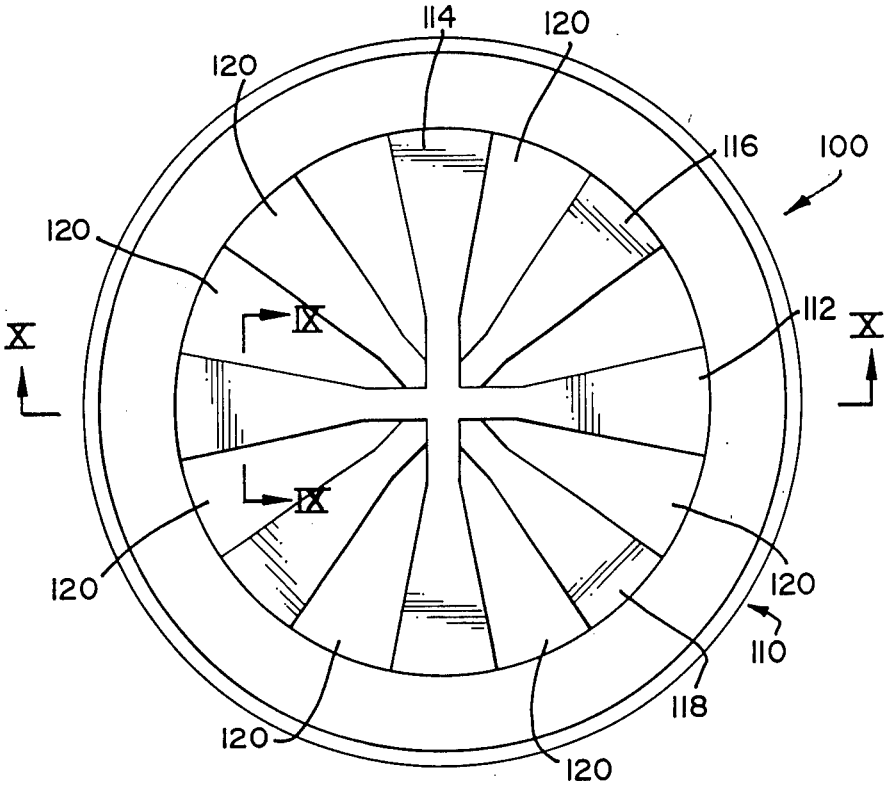
FIG. 8 shows a plan view of a domed reservoir made according to the method of the fourth aspect of the invention with details omitted for clarity.
Figure 9:
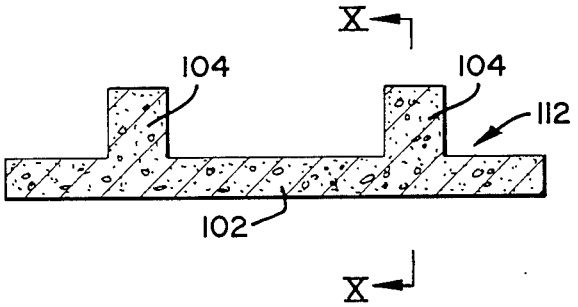
FIG. 9 shows a cross-sectional view through IX—IX of one of the segments of the domed reservoir of FIG. 8.

Referring to FIGS. 1 to 7, reference numeral 20 generally indicates a domed reservoir built, made or constructed according to the method of the first aspect of the invention.

The reservoir 20 includes an upwardly extending continuous round cylindrical skirt or reservoir body 21 of cementitious material standing on a circular concrete foundation/floor 22. A continuous ring beam 24 is located on top of the skirt 21. The ring beam 24 comprises an annular portion 26 which rests on top of the skirt 21, a skirt-like portion 27 protruding upwardly from the portion 26, and a circumferentially extending load bearing portion 29 which flares radially inwardly and upwardly from the portion 27. The ring beam also has circumferentially spaced buttress portions 62. Load bearing material 64 is located between the body 21 and the ring beam 24.

The reservoir 20 includes a domed top 30 attached to the ring beam 24. The domed top or roof 30 comprises a plurality of dome units 35. Each unit 35 comprises a panel-like body having a lower surface 36 and an upper surface 38. Spaced strengthening ribs 37 protrude from the bottom surface 36. It also has laterally spaced side edges 40 and 42, as well as longitudinally spaced end edges 44, 46. Along the edge 44 there is provided an elongate protruding lip 43 protruding beyond the edge 44 and depending below the bottom surface 36, so that the edge 44 is in the form of a shoulder. Hence, an elongate recess 45 is defined by the shoulder 44 and the lip 43. The edges 40, 42 have recessed portions 47 as well as portions 48 protruding beyond the surface 36.

In use, the skirt 21 will be erected first, whereafter the ring beam 24 will be located, eg cast, in position. Thereafter, scaffolding or the like (not shown) will be erected within the skirt 21 so that the scaffolding or the like extends up to the portion 29 of the ring beam 24. The innermost peripheral edge 23 of the ring beam 24 is also provided with a protruding lip 25. A plurality of the units 35 will then be arranged in a first annular course 52 located immediately adjacent the ring beam 24. Hence, the first course 52 is comprises an annular ring of units mating with the ring beam 24.

The edges 46 of the units 35 are located on the lip 25 of the ring beam, and are spaced with clearance from the edge or shoulder 23 of the ring beam. Suitable reinforcing (66) is located within the gap between the edges. Thereafter, settable material (68) eg rapid setting, shrinkproof grout, is inserted into the space, thereby to fill the space. This joins the units together and also seals off the gap. Likewise, the portions 48 of the edges 42, 40 of adjacent units 35 are located in abutting relationship with the portions 47 being spaced with clearance from each other. The gaps between the portions 47 are also filled with settable material. When the settable material has set, a subsequent annular course 54 of the units, located radially inwardly of the first course of units can be located in position. Further successive annular courses 56 and 58 can then be located in position successively. A central ventilation unit 60 is then located in position, and a final annular portion 59 is located or cast in position around the unit 60. After the domed top has been completed, all scaffolding or the like supports can be removed, ie the domed top is self supporting and needs not be supported in position by supports, Preferably, the units 35 are provided in a number of standard sizes. The units can then be used to make a dome for any diameter reservoir. To accommodate the standard units, the pitch of the dome and/or the size of the portion 59' can be varied.

In one embodiment of the invention, the units 35 may be precast or prefabricated from cementitious material, such as concrete. They may then either be reinforced or pre-stressed. Some of the units may be about 2,5 m$\times$1,4 m$\times$8 cm.

In another embodiment (not shown), one or both of the edges 44, 46 may be arcuate-shaped when the unit is seen in plan view.

The units may have a strength of about 30 MPa.

In another embodiment of the invention, the units 35 may be prefabricated or precast from plastics material, eg synthetic plastics material. The plastics material may be reinforced. For example, the units 35 may be prefabricated from settable resin or plastics material reinforced with glassfibres. The settable material used to attach the units together may then also be a settable plastics material.

If desired, an annular strengthening ring beam (not shown) may be attached to one or more of the courses 52–58. In one embodiment, the strengthening ring beam may then be provided on top of the units constituting the course, the ring beam then being cast in situ, eg by means of a suitable temporary formwork, after the units have been located in position. In another embodiment, the ring beam can be located on the underside of the course, the ring beam being made up of a beam section on each unit in the course, in proximity to its edge 44. For example, the beam section of each unit may comprise a thickened or strengthened lip 43. The beam sections may then also be attached together to form the continuous strengthening ring beam.

Referring to FIGS. 8 to 11 of the drawings, reference numeral 100 generally indicates a domed reservoir made according to the method of the fourth aspect of the invention.

Parts of the reservoir 100 which are the same or similar to those of the reservoir 20 hereinbefore described with reference to FIGS. 1 to 7, are indicate with the same reference numerals.

The reservoir 100 also has an upwardly extending round cylindrical skirt or reservoir body 21, on the top of which is located a continuous peripheral ring beam 24.

The reservoir 100 also includes a dome, generally indicated by reference numeral 110. The dome 110 includes a first segment or section 112 extending diametrically across the reservoir, as well as a section or segment 114, also extending diametrically and located orthogonally to the section or segment 112. It also includes a diametrically extending section 116, as well as a diametrically extending section 118 extending orthogonally to the section or segment 116. The sections or segments 116, 118 are located equidistantly between the sections or segments 112, 114. Finally, the dome 110 includes sections or segments 120 located between the segments or sections 112, 114, 116, and 118. Hence, the dome 110 comprises sixteen sections or segments. In other embodiments (not shown) a greater or lesser number of segments or sections can be used.

Each of the sections or segments 112, 114, 116 and 118 comprises a planar portion, as well as a pair of spaced elongate strengthening ribs extending along the planar portion. Hence, the section or segment 112 comprises a planar portion 102 and a pair of spaced strengthening ribs 104 extending along it and which are integral with the planar portion 102. The ribs serve to limit sagging of the dome section after it has been cast. The thickness of the planar portion may be about 18 cm, and the ribs may protrude about 30 cm above the planar portion.

In use, the cylindrical skirt 21 is first erected. Thereafter the ring beam 24 is located in position. The ring beam 24 merely rests on the upper end of the skirt 21, thereby to permit expansion and contraction of the ring beam and the dome relative to the skirt 21.

An arcuate-shaped framework 122 is then located inside the skirt 21. An arcuate-shaped mould 124 which is shaped to provide the required configuration or geometry of the dome 110, is attached to the framework 122. The mould 124 overlaps the ring beam 24 slightly to provide continuity. The mould is shaped so that one of the sections or segments 112, 114, 116 or 118 can be moulded therein. A further framework (not shown) extends orthogonally to the framework 112 and is attached thereto, and a similar mould is attached to this framework. The moulds are joined together at the apex of the dome.

A pair of wheels 126 is rotatably attached to the framework 122. The wheels of the pair are spaced from each other and are located at or near the respective ends of the framework 122, ie the wheels are located diametrically opposite to each other. A further pair of wheels (not shown), which is similar to the pair of wheels 126, is also attached to the framework 122. The two wheels at each end of the framework 122 are arranged tandem-fashion.

The other framework is provided with similar pairs of wheels.

An annular formwork, scaffolding, framework or structure 128 is provided within the skirt 21, and an annular guide surface 130 is provided on top of the formwork or scaffolding 128. The wheels engage the annular guide surface 130.

An elongate tensioned tie member 132 extends diametrically across the reservoir and its ends 133 pass through apertures in the portion 27 of the ring beam 24. The ends 133 are threaded and nuts 134 are co-operated therewith. The tie member 132, which may be a tie rod, is tensioned to prevent sagging of the dome structure. In another embodiment (not shown), the tie member 132 may be a cable or the like. The tie member 132 passes between the two wheels located at each end of the framework 122.

The section or segment 112 is then cast in the mould and allowed to set. After the section or segment 112 has set, the framework 122 is then rotated about a central pivotal axis; as follows:

The sides of the mould 124 are removed. Thereafter, the trailing wheel of the two wheels at either end of the framework 122 is lifted. For this purpose, the wheels 126 may be mounted on extensible members, such as jacks (not shown), which are attached to the framework, to permit them to be lifted and lowered relative to the framework 122. Thereafter, the framework 122 is rotated a few degrees until the trailing wheel clears the tie member 132. The trailing wheel is then lowered until it again engages the support surface 130. The framework 122 is then rotated until it is in position to cast the segments or sections 116 or 118.

After the segments or sections 116, 118 have been cast, the framework 122 is then again rotated so that the final sections or segments 120 can be cast.

The skirt 21, the ring beam 24 and the sections or segments may be of cementitious material, such as concrete. In one embodiment of the invention, the skirt and/or the ring beam and/or the segments or sections may be provided with suitable reinforcing, such as metal reinforcing. In another embodiment, the skirt 21 and/or the ring beam 24 and/or the sections or segments may be pre-stressed.

The framework 122 can, if desired, be provided with a pivot pin (not shown) which will then extend upwardly from the mould 124 at the apex of the mould 124. This pivot pin will then be rotatable within an aperture formed in the sections 112, 114, and will serve to guide the framework 122 as it is rotated.

If desired, the framework 122 may be provided with drive means (not shown) for driving it to rotate. For example, the drive means may comprise a motor or engine operatively connected to at least one of the wheels engaging the support surface 130.

Figure 11:
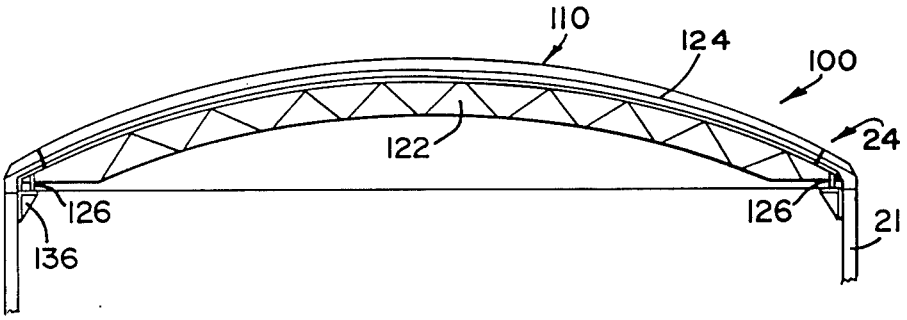
FIG. 11 shows a full sectional view similar to that of FIG. 10, but using a different constructional step to that of FIG. 10.
Figure 10:
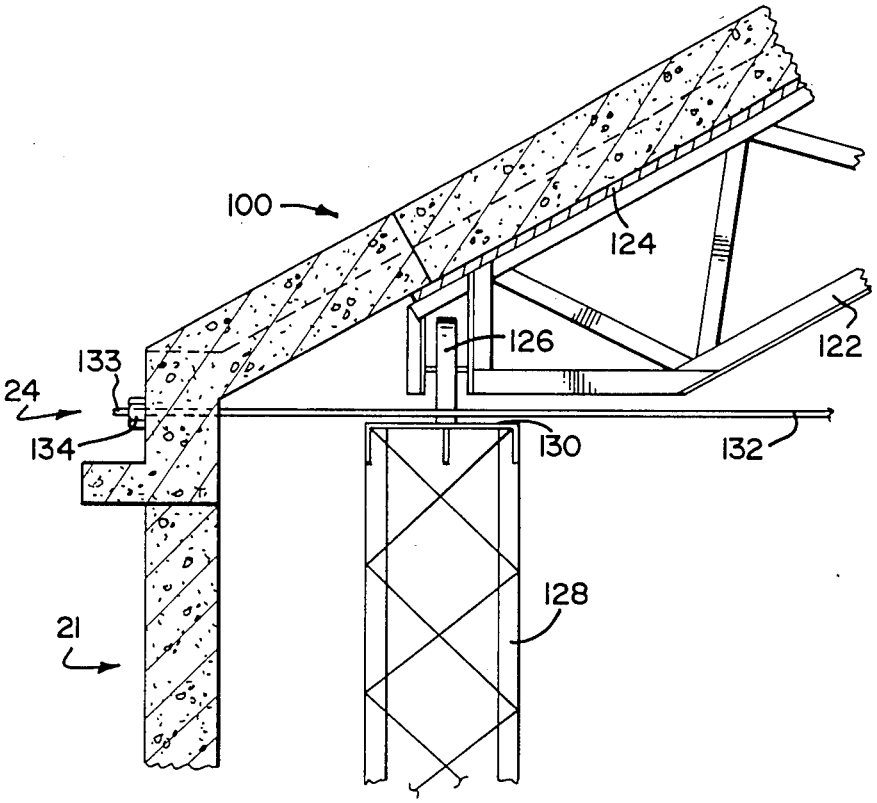
FIG. 10 shows, in part, an enlarged cross-sectional view through X—X in FIG. 8, taken during a step in the construction of the reservoir of FIG. 8.

Referring to FIG. 11, a step in the erection of the reservoir 100, similar to that of FIG. 10, is shown. The only significant difference between the step shown in FIG. 11 and that shown in FIG. 10 is that in FIG. 11 the scaffolding or formwork 128 has been dispensed with. Instead, a suitable framework 136 is attached to the skirt 21 at an elevated level, the support surface 130 then being attached to the framework 136.

Figure 12:
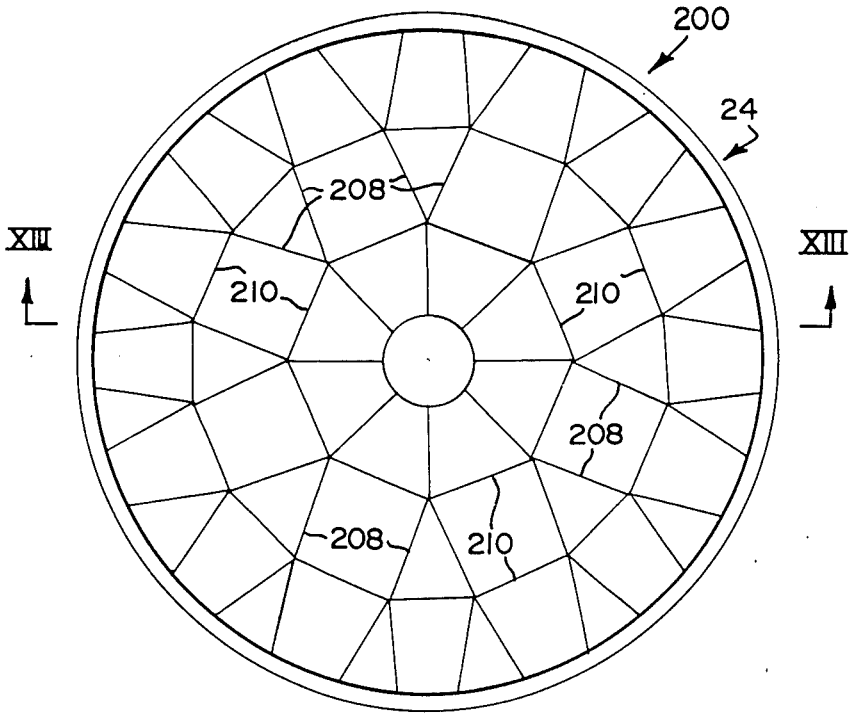
FIG. 12 shows a plan view of a domed reservoir made according to the method of the sixth aspect of the invention, with its cover removed.
Figure 13:
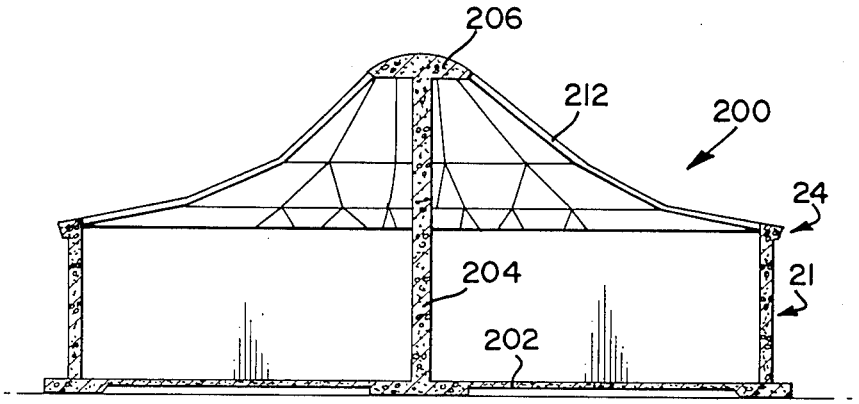
FIG. 13 shows a sectional view through XIII—XIII in FIG. 12.

Referring to FIGS. 12 and 13, reference numeral 200 generally indicates a domed reservoir erected by the method of the sixth aspect of the invention.

Parts of the reservoir 200 which are the same or similar to those of the reservoirs 20 and 100 hereinbefore described with reference to FIGS. 1 to 11, are indicated with the same reference numerals.

The cylindrical skirt 21 of the reservoir 200 is mounted on a circular base 202. A concrete mast 204 protrudes upwardly from the base 202, and is provided with a circular end cap 206. The end cap 206 is arcuate-shaped in cross-section. The mast 204 extends above the ring beam 24. A plurality of flexible tie members 208, such as cables, extend radially outwardly from the end cap 206 to the ring beam 24, and are attached to the ring beam 24. The tie members 208 are interconnected by means of concentric flexible tie members 210. A cover 212, which may be of flexible plastics material, is located on top of the tie members 208 and 210, and is attached thereto by any suitable means, such as clips, tie elements, or the like. The cable may be unbonded prestressing cable.

In another embodiment (not shown), the cover material may be sheets of fairly rigid plastics material attached together in such a fashion that the cables are sandwiched between them, eg the cables may be sandwiched between inverted U-shaped portions of the sheets thereby to encase or ensheath the cables. The sheets may be rivetted together.

The Applicant believes that the domed reservoirs according to the invention will be relatively inexpensive to manufacture, will be sturdy and durable, and will have relatively low maintenance costs.

Typically, the reservoir diameter may be between 10 m and 60 m, eg about 30 m. The apex of the dome may be between 10 and 20 metre above ground level, and the height of the body 21 may be about 8 to 12 m. The width of the portion 29 of the ring beam 24 may be between about 0,5 and 1,5 m, and the strength of the ring beam may be from 25 to 45 MPa.

We claim:

1. A method of making a domed building structure, which includes casting a continuous ring beam having a inwardly extending peripheral locating formation, in position along the top of an upwardly extending continuous, rounded wall;

thereafter locating a plurality of prefabricated dome units adjacent one another on the locating formation of the ring beam in a first course extending along the inner periphery of the ring beam, with the distance which the course protrudes inwardly from the ring beam being greater than the thickness of the units, and with locating formations on the units extending inwardly, thereby to form at least a portion of a self supporting domed top on top of the wall; and locating further prefabricated dome units adjacent one another on the locating formations of the dome units making up the first course to form a second course of dome units abutting the first course and hence extending along the inner periphery of the first course, thereby to form a further portion of the self supporting domed top.

2. A method as claimed in claim 1 wherein the units have upper and lower surfaces and are of substantially constant thickness, and wherein the locating formation of the ring beam comprises a peripheral lip protruding beyond a peripherally extending shoulder on the ring beam, the location of the units on the ring beam lip being effected by mating edges of the units with the lip of the ring beam so that portions of the units rest on the lip, with the lip protruding below the lower surfaces of the units.

3. A method as claimed in claim 2 wherein said edges of the units are spaced with clearance from the shoulder of the ring beam so that a gap is defined between the shoulder, the edges of the units and the lip, the method including introducing reinforcing and a settable material into the gap.

* * * * *